US007726078B2

(12) United States Patent
Kolozsvary-Kiss

(10) Patent No.: US 7,726,078 B2
(45) Date of Patent: Jun. 1, 2010

(54) ROOF ARCHES WITHOUT BENDING MOMENTS

(76) Inventor: Arpad Kolozsvary-Kiss, 9 Whitley Rd., Exeter, NH (US) 03833

( * ) Notice: Subject to any disclaimer, the term of this patent is extended or adjusted under 35 U.S.C. 154(b) by 0 days.

(21) Appl. No.: 11/921,949

(22) PCT Filed: Jun. 21, 2005

(86) PCT No.: PCT/HU2005/000066

§ 371 (c)(1),
(2), (4) Date: Dec. 11, 2007

(87) PCT Pub. No.: WO2006/136867

PCT Pub. Date: Dec. 28, 2006

(65) Prior Publication Data

US 2009/0044459 A1 Feb. 19, 2009

(51) Int. Cl.

| | |
|---|---|
| ***E04B 1/32*** | (2006.01) |
| ***E04B 7/10*** | (2006.01) |
| ***E04B 7/14*** | (2006.01) |
| ***E04B 7/08*** | (2006.01) |

(52) U.S. Cl. ..... 52/86; 52/80.1; 52/80.2; 52/83; 52/81.2

(58) Field of Classification Search ..... 52/86, 52/83, 80.1, 80.2, 81.1–81.3
See application file for complete search history.

(56) References Cited

U.S. PATENT DOCUMENTS 3,676,964 A * 7/1972 Anglade, Jr. ..... 52/86
3,863,659 A * 2/1975 Gillis ..... 135/136
3,886,961 A * 6/1975 Geiger et al. ..... 52/63
3,909,993 A * 10/1975 Huddle ..... 52/63
4,065,906 A * 1/1978 Mears ..... 52/745.08
4,143,502 A * 3/1979 Wyche ..... 52/745.08
4,325,207 A * 4/1982 Russell et al. ..... 52/641
4,704,754 A * 11/1987 Bonasso ..... 14/20
4,982,534 A * 1/1991 Saitoh et al. ..... 52/63
5,345,962 A * 9/1994 Moss ..... 135/124
5,355,641 A * 10/1994 Levy ..... 52/66
5,381,634 A * 1/1995 Pietrogrande et al. ..... 52/86
5,848,499 A * 12/1998 Schildge, Jr. ..... 52/66

* cited by examiner

*Primary Examiner*—Richard E Chilcot, Jr.
*Assistant Examiner*—Mark R Wendell

(57) ABSTRACT

A dome type clear-span roof construction, having an exterior, polygonal arch frame (1), and a pre-tensioned, doubly curved membrane cover (2), which is suspended from the arch frame and is tied down to anchors (9) along its perimeter. Underneath the arch frame, a single, continuous suspension cable (4), anchored to the arch's end supports (8), is alternately taken through a series of upper pulleys (6) secured to the underside of the arch break points, and lower pulleys (5) secured at similar spacing to the membrane's ridge line (3), creating a multiple block-and-tackle suspension mechanism in the full length of the arch. The suspension mechanism converts the random membrane loads into concentrated, identical arch loads. The centerline of the polygonal arch coincides with the constant pressure line of its concentrated loads, which therefore do not cause bending moments in the arch.

7 Claims, 3 Drawing Sheets

ROOF ARCHES WITHOUT BENDING MOMENTS

FIELD OF THE INVENTION

Figure 1:
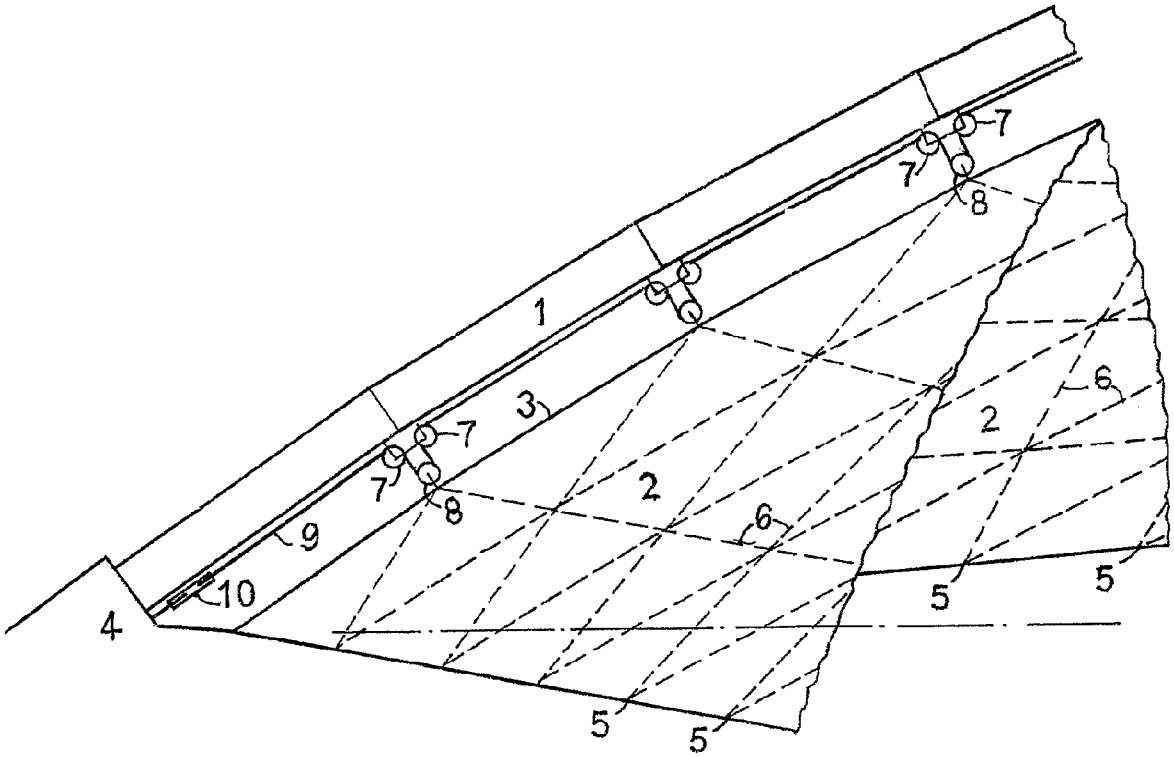

The invention relates to clear-span dome roofs, with tensioned membrane covers supported by one arch or a plurality of arches.

BACKGROUND OF THE INVENTION

Arches are widely used as supports for membrane roofs with long spans and no internal supports. The maximum length of clear-span arches, built with known technologies, is limited by the magnitude of stresses in the arches cross sections, due to axial compression forces and bending moments. As arch spans increase, the increase in stresses due to axial compression is linear, but the increase in flexural or bending stresses is exponential. Therefore, in order to build arches with longer spans, and also with greater material economies, their bending moments are to be reduced or preferably eliminated altogether. In theory this is possible, but only with symmetrical loading, such as uniformly distributed snow load, because the arch curve can be designed to coincide with the pressure line of such symmetrical load, in which case no flexural stresses will result in any cross section of the arch. However, in reality, natural loads on roofs are not symmetrical. Snow load may be symmetrical, but very rarely, and only for a short time, and wind load never is.

Therefore, in order to build arches with longer clear spans, and greater material economy, than what is possible with known techniques of the prior art, a novel method and apparatus is needed, which reduces or eliminates the bending moments in arches, by converting asymmetrical roof loads into symmetrical arch loads. Such method would be especially advantageous, if it also assures that the arches' loads so converted remain not only symmetrical but also equal with each other, at all times, because the pressure line of such loads is a constant curve, and if the arch curvature is designed to follow this pressure line, then the arch will be free of bending moments at all times. The purpose of this invention is to provide such method and apparatus, that eliminates bending moments from roof arches, and thereby increases the length of their maximum clear span.

SUMMARY OF THE INVENTION

In reality snow and wind load on a curved roof are always asymmetrical. Therefore, as long as a roof arch is subjected to such loads directly, it would be impossible to convert these loads into symmetrical ones. This invention is based on the discovery, that if these loads are acting directly not on the roof arch, but on a separate roof surface suspended below the arch, then, by using a special suspension mechanism to transfer the loads of that separate surface to its supporting arch, they can be converted from asymmetrical surface loads into symmetrical arch loads.

The present invention is therefore applicable, for example, to structures in which a pre-stressed membrane surface is supported by one or more arches. In most such structures of the prior art, the membrane surface is placed on top of the supporting arches. In the structures of the present invention, the membrane is suspended underneath the arches. It is through the suspension mechanism that the asymmetrical membrane loads are converted to symmetrical arch loads.

The suspension mechanism of the invention is based on the well know physical law of block and tackle, in which a continuous, flexible, linear tensile element, such as a rope or a cable, is taken through a series of pulleys or sheaves. In such an apparatus the forces in all sections of the cable are equal, regardless of the magnitude of loads applied to individual pulleys. By suspending a pre-stressed membrane cover from its supporting arch by a single, continuous suspension cable, that is taken through a series of lower and upper pulleys, all asymmetrical and unequal membrane loads are transmitted to the arch as concentrated, symmetrical and equal arch loads, and therefore the arch can be designed to support these loads in axial compression only, without bending moments.

DETAILED DESCRIPTION OF THE INVENTION

FIG. 1 is a fragmentary view of a corner of the structure. It shows the polygonal arch 1, and the flexible membrane cover 2 suspended below the arch. The ridge cable 3, which is anchored down to the arch footing 4, and is extended parallel with the polygonal arch, forms the upper edge of the membrane cover's two surfaces. The lower edges of the membrane cover are tied down to peripheral anchors 5. The membrane cover may also have additional reinforcing 6, made of webbing, cables or rods, shown with dash lines.

Pairs of upper pulleys 7 are secured to the underside of the polygonal arch's break points. Similarly spaced single lower pulleys 8 are secured to the membrane cover's ridge cable 3. A single, continuous suspension cable 9, anchored to the arch footing 4, is taken through an upper, a lower, and an upper pulley, and then over to the next group of three pulleys, together comprising a series of block-and-tackle units of the suspension mechanism.

Tensioning the suspension cable 9 with a turnbuckle 10, or a winch, or with other suitable tensioning means, pulls the upper and lower pulleys towards each other. This causes compression in the arch, and tension in the membrane cover.

Figure 2:
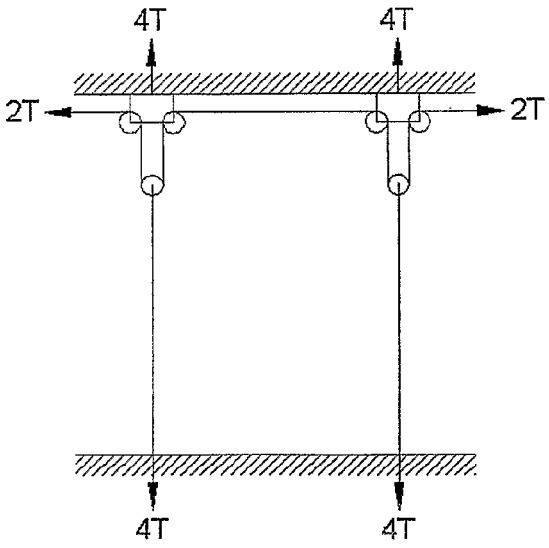
Figure 3:
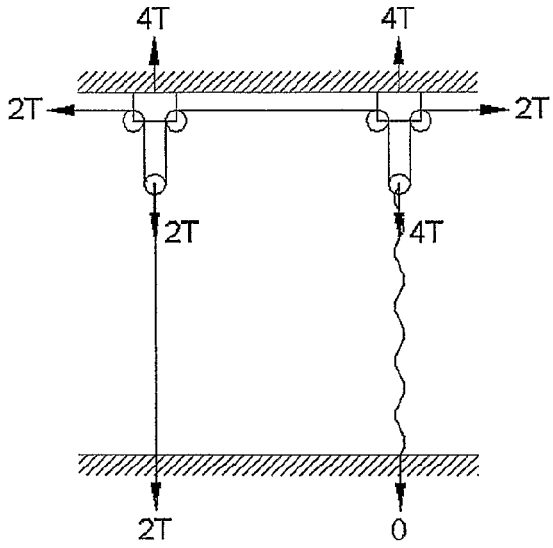

The importance of tying down the membrane cover to the peripheral anchors is illustrated in FIGS. 2 and 3, each showing two sets of block-and-tackle, attached to the support above, and tied down by cables to the floor below. In these schematic drawings the tie-down cables represent the tensile membrane of the structure. In FIG. 2 the suspension cable is pre-tensioned with a 2T force, causing identical 4T loads, or reactions, in the floor below and in the support above. In FIG. 3 two unequal loads are added. At the suspension unit on the left 2T is added, which reduces at that location the tie-down cable force and its reaction in the floor to 2T. At the suspension unit on the right 4T is added, which reduces at that location the tie-down cable force and its reaction in the floor to 0. It is seen, that the addition of these different loads does not alter the magnitude of the identical reaction forces of the overhead support. Adding the 4T load eliminates the initial tension of the right tie-down cable, which becomes slack. However, this could be prevented by increasing the suspension cable's initial pre-tensioning. This simple, schematic presentation of the principle of the suspension method and apparatus demonstrates how a structure of this invention can be "tuned" to its anticipated loads.

Tension membrane structures acquire their dimensional stability by being pre-tensioned into doubly curved, anticlastic or saddle surfaces, in which the curvatures in opposite directions have opposite signs, i.e. concave vs. convex. In FIGS. 4, 5, 6 and 7, which are conceptual drawings of various structural embodiments of the invention, the membrane curvatures are indicated by straight lines, which follow the surface curvature tangentially. However, in large structures these lines may also represent a cable net, reinforcing the coated fabric skins, or a network of tension rods, supporting building panels. The drawings show the direction of the suspension loads as radial, therefore the break points of the polygonal arches are on a circle.

Figure 4:
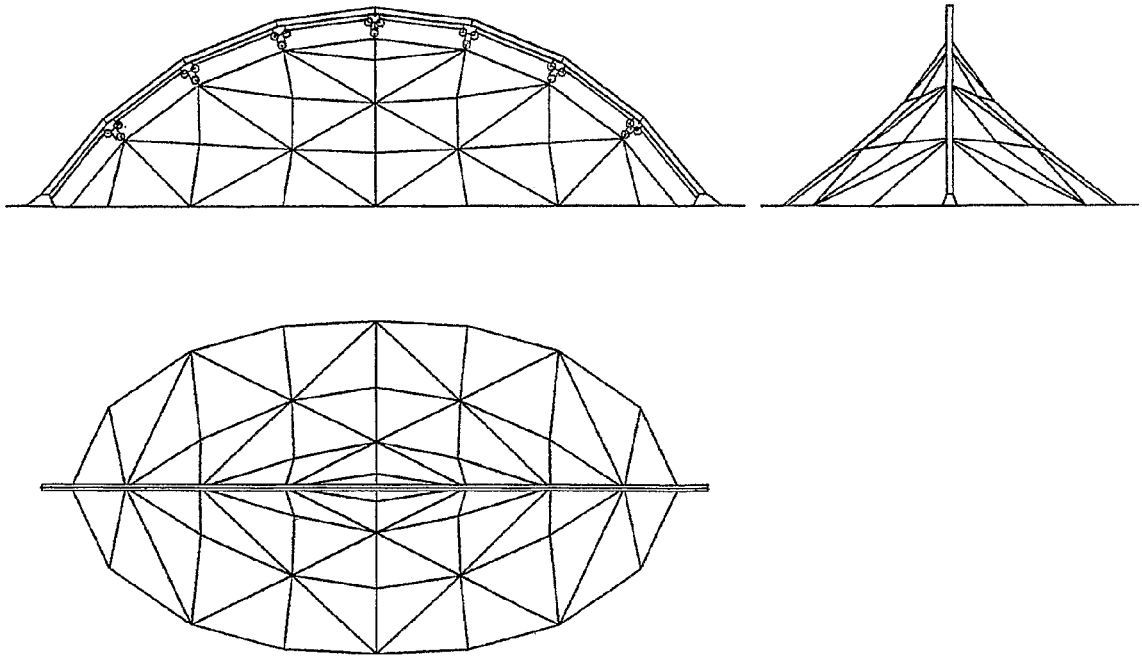

FIG. 4. shows three projected views of a membrane structure, having one supporting arch, and a tensioned membrane cover, suspended from the arch along its ridge line, and divided into two opposing, anticlastic surfaces, which are anchored down along the curved perimeter of the enclosed space.

Figure 5:
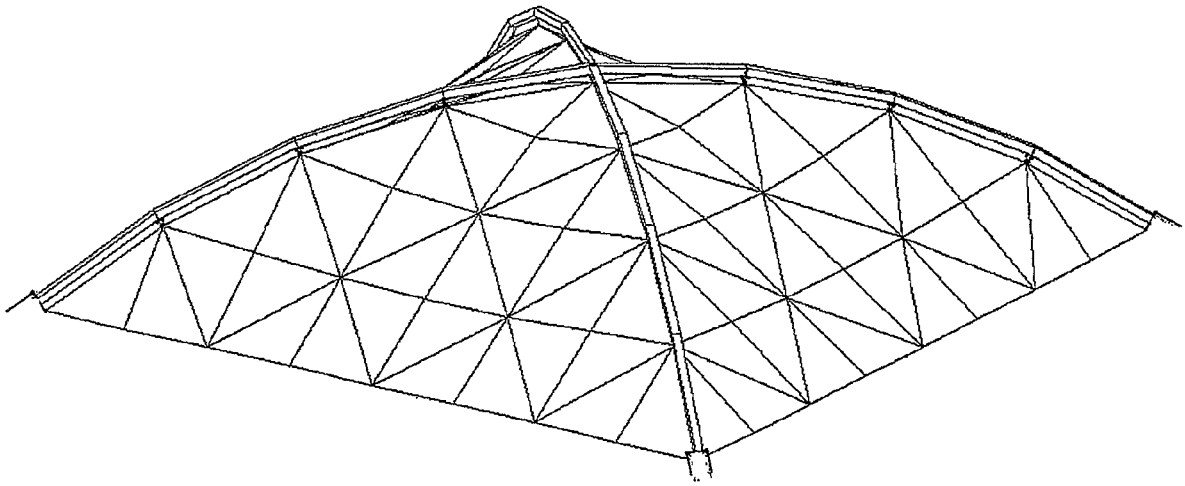

FIG. 5. is a perspective view of a roof structure covering a square plan, having two diagonal supporting arches intersecting at the apex, and a tensioned membrane cover, suspended from the arches along its ridge lines, comprising four anticlastic surfaces. The anchors are located along the four sides of the covered square.

Figure 6:
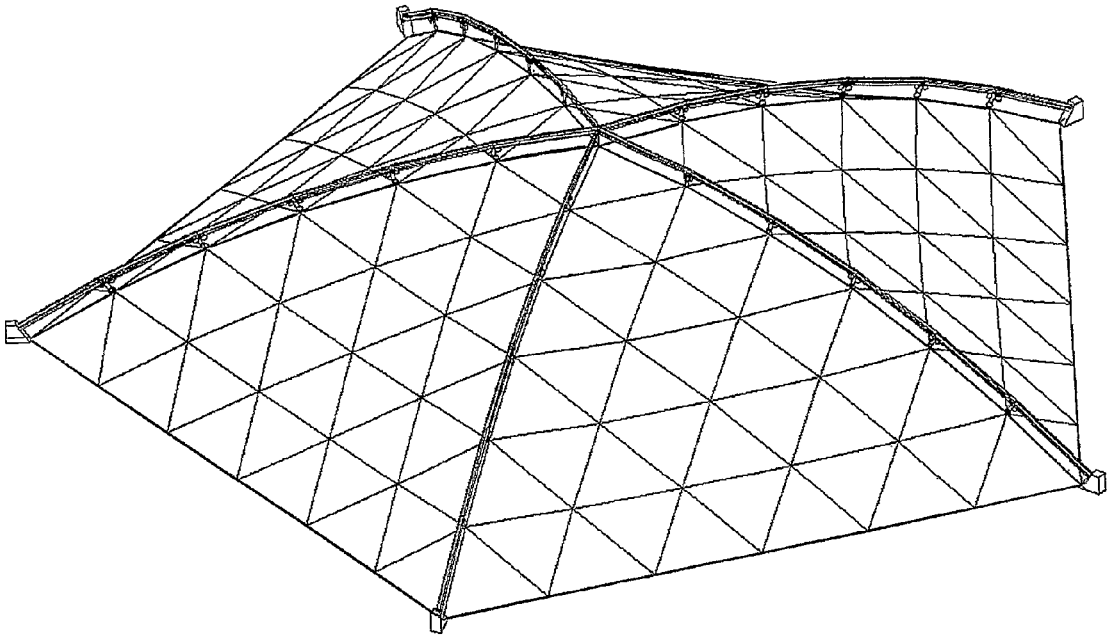

FIG. 6. is a perspective view of a roof structure covering a pentagonal plan, having five half-arch supports connected to each other at the apex of the structure, and a tensioned membrane cover, suspended from the half-arches along its ridge lines, comprising five anticlastic surfaces.

Figure 7:
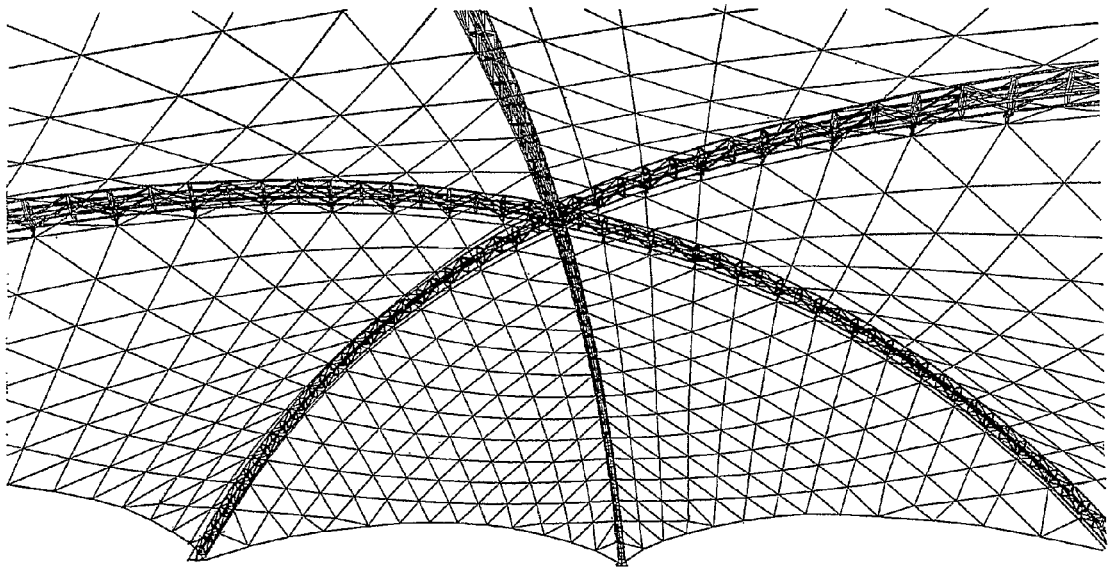

FIG. 7. is an interior perspective view of a roof structure covering a hexagonal plan, having three diagonal arches which intersect at the apex. The arch supports may also be described as six half-arches which are connected to each other at the apex. The tensioned membrane cover, suspended from the arches along its ridge lines, is comprised of six anticlastic surfaces. The bottom edge of each of the six surfaces is terminated along a base catenary cable, which is secured to two arch bases. For the sake of clarity the membrane is not shown in this interior view. However, the drawing may also be considered as showing a membrane that is made of a transparent foil, supported by a cable net or a grid of tensioned rods.

For simplicity and clarity, the drawings show the arches as having fixed connections to their supports and to each other at the apex. These connections may be hinges. The break points of the polygonal arches are shown as being identically spaced on a circle, with suspension loads in radial directions. In reality, the arch curves and suspension directions may be altered by the distribution of the arches' self weight, by equipment suspended from the apex, or by other factors. Structural details not directly related to the invention, such as varying arch width, or additional guy cables, which may be used as means to prevent lateral buckling or bending of the arches, are not shown.

The membrane's elastic or thermal expansion or contraction will slightly alter the direction of the arches' suspension loads. Snow, wind and other loads acting directly on the arches themselves will also cause slight eccentricities of the arch's pressure line. However, these effects are very small compared to the magnitude of the membrane loads, which do not cause bending moments in the roof arches.

In addition to its primary object of creating clear-span roof structures with much longer spans and greater economies, than what is possible with known technologies of the prior art, another object of the invention is to erect these structures easier, faster and safer.

It is a well-known fact, that large sheets made of coated fabric, foil, or other flaccid materials, are extremely vulnerable to wind damage during erection, prior to becoming fully pre-tensioned in their final shape. In fact, the membranes of large roof structures of the prior art, and even their supports, may be subjected to higher stress levels during erection, than the maximum design stresses of the completed structure.

The preferred method of erecting the structures of this invention begins with first completing the arch frame first. The flaccid membrane sheet is laid out on the ground next, together with its reinforcing cable net, if such is used. Finally, on a calm day, the membrane is lifted up with the suspension pulley system, in a matter of hours, until the membrane is in its final position and it is fully pre-tensioned with the suspension cables. To dismantle, the same procedure is reversed. To provide a more energy efficient and more reliable alternate for air supported structures, the membrane may be seasonally dismantled and re-installed, leaving the arches permanently in place.

The membrane cover of very large structures of the invention, instead of being a single, continuous flaccid sheet, may preferably be constructed as a pre-tensioned anticlastic surface grid, with individual, prefabricated building panels secured to it. The surface grid may have continuous cables, or may be assembled from individual steel rods with threaded ends and connection hubs. Erection of such structures starts with building the arch frame and the surface grid together. When the arch frame and the surface grid are completed, the suspension cable is tensioned to the maximum force to which it will be subjected at any location by any design load or combination of loads. This unique capability to be preloaded, upon erection, with its most extreme design load, gives a structure of the invention unprecedented safety. When pre-loading is done, the building panels are individually lifted up and are secured to the surface net. This may start with panels at any location, and may proceed in any sequence, because regardless of the location of such random surface loads, the arch loads remain symmetrical and identical at all times. For the same reason, the completed structure may have openings of any size, anywhere in the membrane surface, for ventilation or for other purposes.

What is claimed is:

1. An arch supported tensioned membrane roof structure, comprising a polygonal arch support, a doubly curved, flexible membrane cover, suspended from the arch by means of a ridge cable attached to said membrane cover substantially in the full length of the arch, and said cover being also anchored down along the cover's perimeter, a single, continuous suspension cable, extended underneath the arch, the suspension cable's ends being secured by adjustable means to the arch's end supports, the suspension cable being taken alternately through upper pulleys secured to the break points of the polygonal arch support, and through lower pulley secured to the ridge cable of the membrane cover, the suspension cable and the pulleys together forming a continuous suspension means of multiple block-and-tackle units, which suspension means convert the membrane's randomly distributed snow and wind loads into identical, concentrated arch loads, the polygonal supporting arch having its centerline designed to coincide with the resultant pressure line of its concentrated, identical loads, which are transferred from the membrane cover to the arch by the said suspension means, therefore such loads do not cause bending moments in the supporting arches.

2. A roof structure according to claim 1, in which the membrane cover is made of a flexible material.

3. A roof structure according to claim 2, in which the membrane cover is reinforced with a tensioned grid of cables.

4. A roof structure according to claim 1, in which the membrane cover is made of a tensioned grid of cables with roof panels secured thereto.

5. A roof structure according to claim 1, comprising a plurality of polygonal supporting arches.

6. A roof structure according to claim 5, in which the arches are in intersecting planes and are connected to each other at the apex of the structure.

7. A roof structure according to claim 5, in which the arches are in parallel planes.

* * * * *